US009259040B2

(12) United States Patent
Ryu

(10) Patent No.: US 9,259,040 B2
(45) Date of Patent: Feb. 16, 2016

(54) TAEKWONDO UNIFORM

(76) Inventor: Seng-Gyu Ryu, Cheongju-si (KR)

( * ) Notice: Subject to any disclaimer, the term of this patent is extended or adjusted under 35 U.S.C. 154(b) by 127 days.

(21) Appl. No.: 13/701,824

(22) PCT Filed: Oct. 28, 2011

(86) PCT No.: PCT/KR2011/008147
§ 371 (c)(1),
(2), (4) Date: Dec. 3, 2012

(87) PCT Pub. No.: WO2012/064039
PCT Pub. Date: May 18, 2012

(65) Prior Publication Data

US 2013/0086728 A1 Apr. 11, 2013

(30) Foreign Application Priority Data

Nov. 11, 2010 (KR) ..... 10-2010-0112242
Oct. 4, 2011 (KR) ..... 10-2011-0100666

(51) Int. Cl.
*A41D 13/00* (2006.01)
*A41D 29/00* (2006.01)

(52) U.S. Cl.
CPC ..... *A41D 13/0015* (2013.01); *A41D 13/0017* (2013.01); *A41D 29/00* (2013.01)

(58) Field of Classification Search
CPC ..... A41D 13/00; A41D 13/0015
USPC ..... 2/69, 70, 115, 114, 106, 108, 48, 88, 2/127
See application file for complete search history.

(56) References Cited

U.S. PATENT DOCUMENTS

| | | | | | |
|---|---|---|---|---|---|
| 1,489,046 | A | * | 4/1924 | Thompson | 2/114 |
| 1,603,481 | A | * | 10/1926 | Marquisee | 2/127 |
| 2,634,422 | A | * | 4/1953 | Cantrell | 2/271 |
| 3,276,036 | A | * | 10/1966 | Cater et al. | 2/114 |
| 3,369,256 | A | * | 2/1968 | Kern | 2/114 |
| 3,585,640 | A | * | 6/1971 | Belkin | 2/74 |
| 4,937,883 | A | * | 7/1990 | Shirai | 2/115 |
| 4,937,884 | A | * | 7/1990 | Sherman | 2/129 |
| 5,426,787 | A | * | 6/1995 | Freeman | 2/69 |
| 5,887,279 | A | * | 3/1999 | Elting et al. | 2/69 |
| 6,339,866 | B1 | * | 1/2002 | French | 24/306 |
| D509,343 | S | * | 9/2005 | Bragg | D2/840 |
| D574,126 | S | * | 8/2008 | McCray | D2/840 |
| D584,882 | S | * | 1/2009 | Trouillot et al. | D2/720 |
| 2003/0126668 | A1 | * | 7/2003 | Scroggins | 2/114 |
| 2003/0221244 | A1 | * | 12/2003 | Liddell | 2/244 |
| 2009/0260123 | A1 | * | 10/2009 | Swift | 2/69 |
| 2010/0293697 | A1 | * | 11/2010 | McGuyer et al. | 2/114 |

FOREIGN PATENT DOCUMENTS

| | | | |
|---|---|---|---|
| KR | 20-1997-0000488 | U | 1/1997 |
| KR | 10-2002-0017359 | A | 3/2002 |
| KR | 20-0302788 | Y1 | 1/2003 |
| KR | 10-2009-0050703 | A | 5/2009 |

* cited by examiner

*Primary Examiner* — Anna Kinsaul
(74) *Attorney, Agent, or Firm* — Novick, Kim & Lee, PLLC; Jae Youn Kim

(57) ABSTRACT

Disclosed is a taekwondo uniform. At least a portion of the taekwondo uniform has the shape corresponding to that of the human body, and the taekwondo uniform is prevented from being loosed, so that women and men put on the uniform in common with improved wearability and convenient use. Gap adjusting unit mutually corresponding to each other at the back part and the front part of the uniform are provided, so that the wearability of the uniform is improved.

7 Claims, 13 Drawing Sheets

PRIOR ART

TAEKWONDO UNIFORM

TECHNICAL FIELD

The present invention relates generally to a taekwondo uniform having a shape corresponding to that of a human body and a structure of preventing the taekwondo uniform from being loosed so that women and men can wear the uniform in common, thereby improving the wearability of the uniform and allowing a user to conveniently use the uniform.

In more particular, the present invention relates to a taekwondo uniform including gap adjusting units provided at a back part and a front part of a flank side corresponding to each other, so that the uniform top is closely fitted to the upper body of a user to improve the wearability of the user.

BACKGROUND ART

In general, uniforms are clothes which users wear for the exercises such as taekwondo or judo. In particular, the uniform for taekwondo is called a taekwondo uniform.

In addition, the taekwondo uniform is divided into a top and bottoms. The top and bottoms include cotton blends or a spandex material having predetermined elasticity. Each of the top and bottoms are made by sewing symmetric front and back parts.

In relation to the taekwondo uniform, a technology for a taekwondo uniform that is conveniently usable is disclosed in Korean Utility Model Registration No. 302788. The taekwondo uniform includes a body part 10 corresponding to the upper body of a user, a neck part 20 having a collar 100 provided at the upper side of the body part 10 and provided around the neck of the user, and a sleeve part 30 extending from both sides of the body part 10 and the neck part 20 to surround the arm of the user as shown in FIG. 1. In this structure, an armpit part 200 formed between the body part 10 and the sleeve part 30 is stitched in the shape of a wide round to the extent that a marginal space is sufficiently ensured, so that the user can conveniently put on the taekwondo uniform and freely move the arms.

A sleeve end portion 300 is provided at the bottom portion thereof with an upward inclined portion so that the sleeve part 30 of the top of the taekwondo uniform is narrowed toward the sleeve end portion 300. Accordingly, when the user moves the arm, the sleeve end portion 300 is prevented from being fluttered.

However, as described above, since the neck part of the top of the taekwondo uniform is deeply recessed, the breasts may be revealed to the outside in the case of women, thereby making the women unnaturally and carefully behave. Accordingly, in the taekwondo exercise or the taekwondo match, the woman may not conveniently behave.

In addition, generally, women wear T-shirts inside the taekwondo uniform and wear the taekwondo uniform on the T-shirts. However, the public opinion that the style of the taekwondo uniform of the women is a sex discrimination style has been increased. Furthermore, when T-shirts are put on inside the taekwondo uniform, the behaviors of the women are restricted, and it is very hot in the summer season to irritate the women, so that the taekwondo exercise or the taekwondo match may not be smoothly performed.

In addition, since the taekwondo uniform is not matched with the body type of a user, the taekwondo uniform may be turned, so that the user may not concentrate on the exercise. In addition, when the user wearing the taekwondo uniform carries out the daily life such as driving before or after the exercise, the user may not store important objects.

Further, the taekwondo uniform is fitted to the body of the user by a uniform band when the user puts on the taekwondo uniform. However, since the taekwondo uniform has no structure of fixing the uniform to the uniform band, the uniform may be out of the uniform band in the taekwondo exercise or the taekwondo match, so that the user may not concentrate on the taekwondo match.

DISCLOSURE

Technical Problem

Accordingly, the present invention has been made keeping in mind the above problems occurring in the related art, and an object of the present invention is to provide a taekwondo uniform, in which women and men can use the taekwondo uniform in common by preventing the uniform from being loosed, and the uniform is configured to match with the body type of a user with the high wearabilty, so that the performance of players can be improved, the uniform allows trainees to store cellular phones in pockets of the uniform so that the trainees can freely drive a vehicle, and the wearing feeling and the convenience can be increased.

In addition, another object of the present invention is to provide a taekwondo uniform in which the uniform is fitted to the body of a user by mutually linking a front part with a back part, prevented from being loosed during the taekwondo match, and prevented from being tilted back, so that the wearabilty of the uniform can be improved and the user can conveniently use the uniform.

Technical Solution

In order to accomplish the above object, there is provided a taekwondo uniform comprising any one of a uniform top and uniform bottoms. The uniform top includes a neck insertion part. An upper line having a shape of a curved line or a straight line corresponding to a neck line of a human body and a lower line, which has a shape of the curved line or the straight line and both end portions of which are mutually coupled with each other at one point, are continuously formed in the neck insertion part.

In addition, according to the taekwondo uniform of the present invention, the neck insertion part has the shape corresponding to the human body. The vertical length from the upper end to the lower end of the neck insertion part is ⅓ or less based on the total vertical length thereof.

Further, according to the taekwondo uniform of the present invention, the shoulder part of the uniform top or the lateral part of the uniform bottoms is provided at one side thereof with a packet provided at an upper portion thereof with a cover. The fitting lines formed at both sides of the uniform top include continuous straight or curved lines. The curved lines have arcs protruding outward toward the lower portion.

In addition, according to the taekwondo uniform of the present invention, an opening is formed on a curved fitting line, and a zipper is additionally provided to adjust the size of the opening. A reinforcement-material plate is additionally provided on the shoulder part.

In addition, according to the taekwondo uniform of the present invention, the front part and the back part formed about the opening are linked with by a gap adjusting unit, and a plurality of ring parts are provided around the front and back parts to support the uniform band. The ring parts are provided at the edge of the back part and the edge of the front part.

Further, according to the taekwondo uniform of the present invention, the gap adjusting unit includes a first hook and loop tape provided at the edge of the back part and a second hook and loop tape provided inside the front part such that the first hook and loop tape is attached to the second hook and loop tape while moving.

Subsequently, according to the taekwondo uniform of the present invention, the gap adjusting unit includes a button provided at the edge of the back part and a fixing band having a plurality of locking holes such that the button is locked with the locking holes while moving.

In addition, according to the taekwondo uniform of the present invention, the gap adjusting unit includes bands connected to edges of the back part and support holes provided at a central portion of the front part, such that the bands are exposed to the front part while passing through support holes.

In addition, according to the taekwondo uniform of the present invention, a fastening unit including mutually-opposite hook and loop tapes provided at a connection part of a collar, and a sleeve part is linked with a body part by a raglan line.

Advantageous Effects

As described above, according to the present invention, women and men can freely use the taekwondo uniform in common by preventing the uniform from being loosed, and the uniform is configured to match with the body type of a user with the high wearabilty, so that the performance of players can be improved. The uniform allows a user to store cellular phones, notes, or a vehicle key thereof in pockets of the uniform prior to or posterior to the taekwondo exercise, so that the user acting as a trainer can freely drive a vehicle or freely touch other trainees. In addition, the uniform can improve the wearability and can be conveniently used.

The uniform is fitted to the body of the user by mutually linking a front part with a back part, prevented from being loosed during the taekwondo match, and prevented from being tilted back, so the uniform can improve the wearability and can be conveniently used.

DESCRIPTION OF DRAWINGS

FIG. 5 is a perspective view showing the taekwondo uniform according to the present invention when the taekwondo uniform is put on;

BEST MODE

Hereinafter, the embodiments of the present invention will be described in detail with reference to accompanying drawings.

Figure 1:
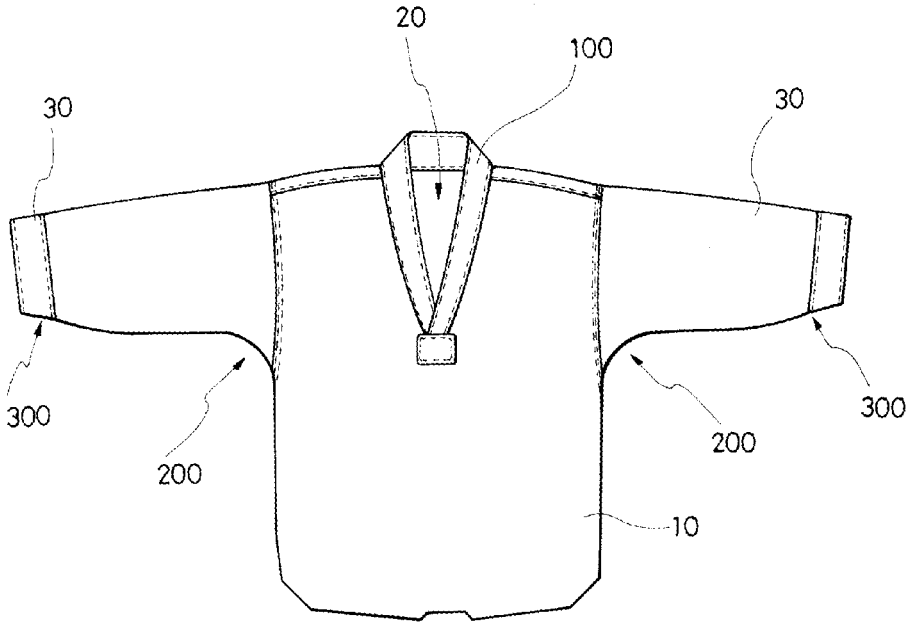
FIG. 1 is a perspective view showing a taekwondo uniform according to the related art.
Figure 2:
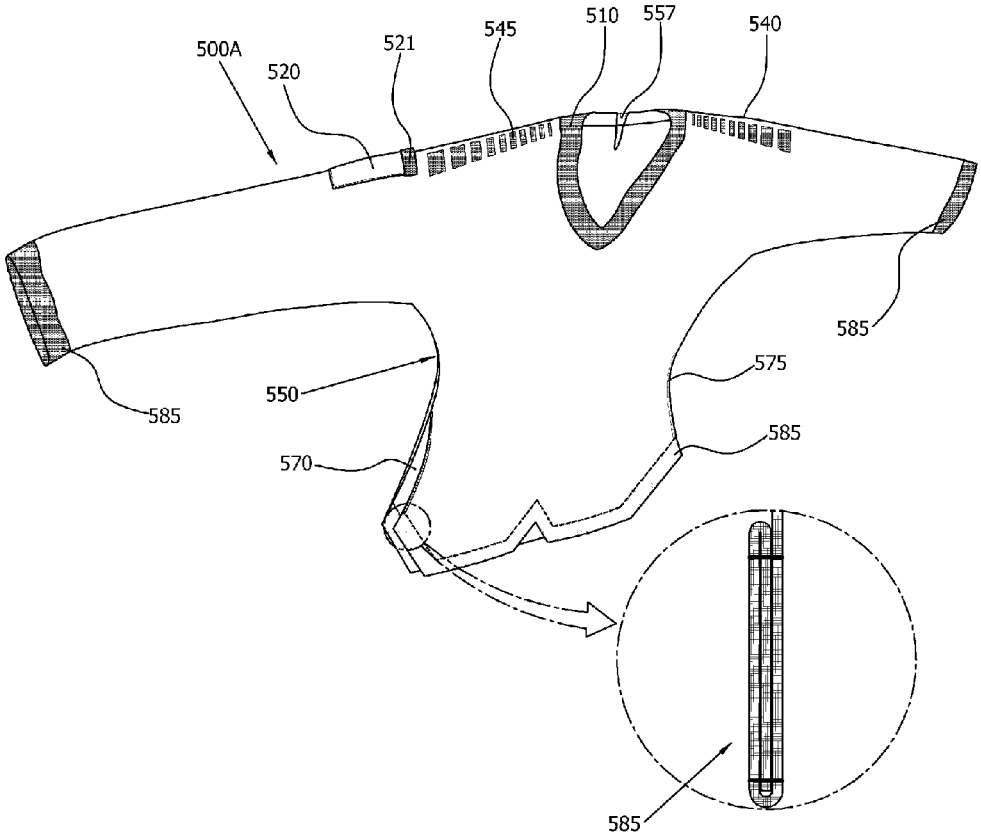
FIG. 2 is a perspective view showing a taekwondo uniform according to the present invention.
Figure 3:
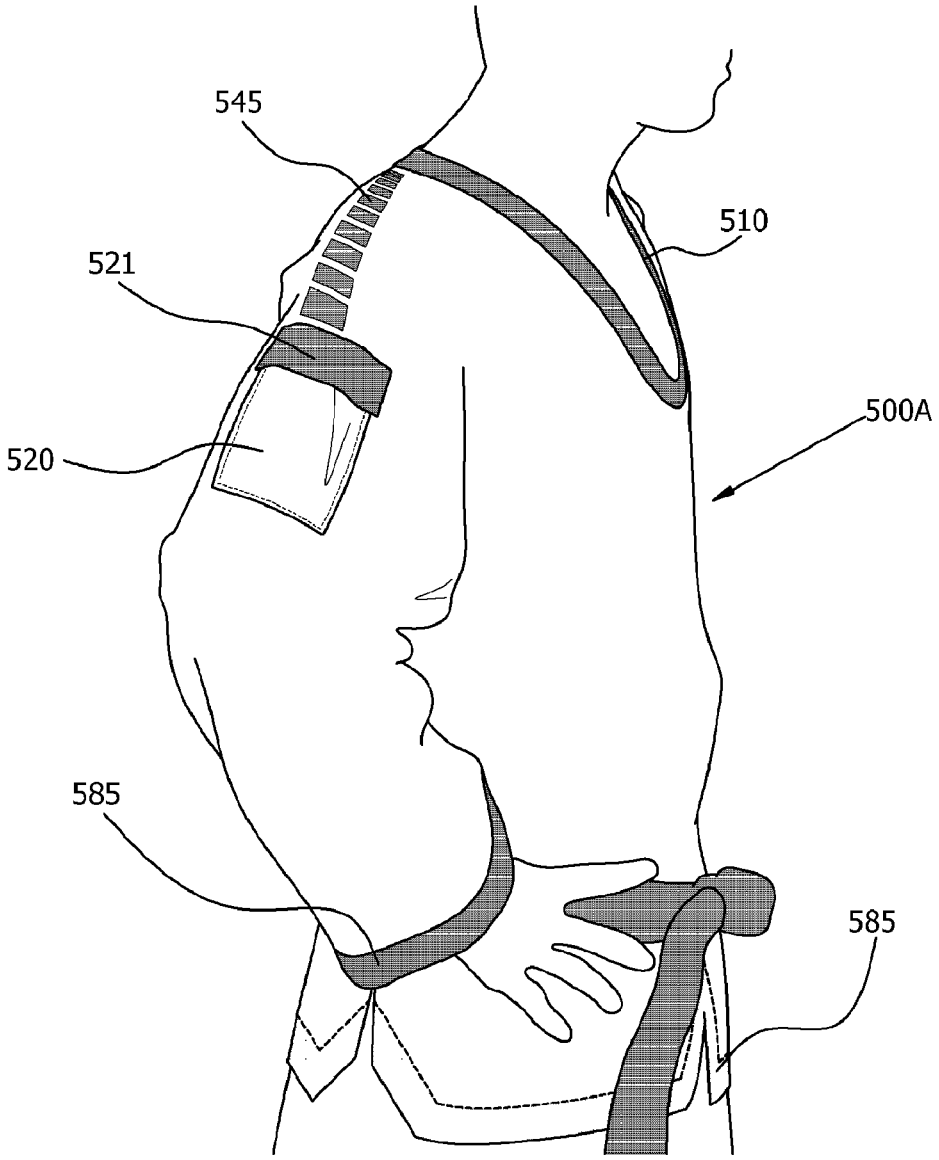
FIGS. 3 and 4 are perspective views showing the top and the bottoms of the taekwondo uniform according to the present invention.
Figure 4:
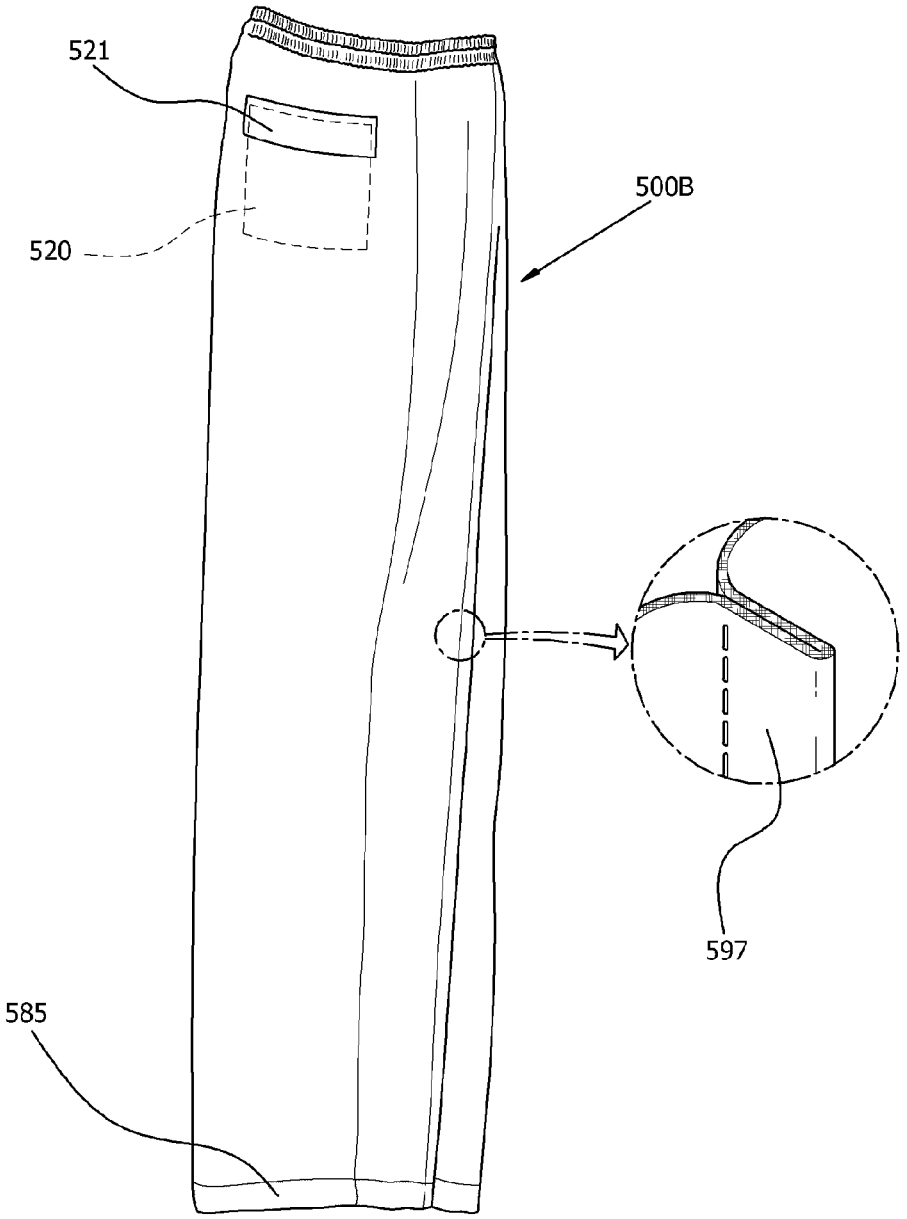
Figure 5:
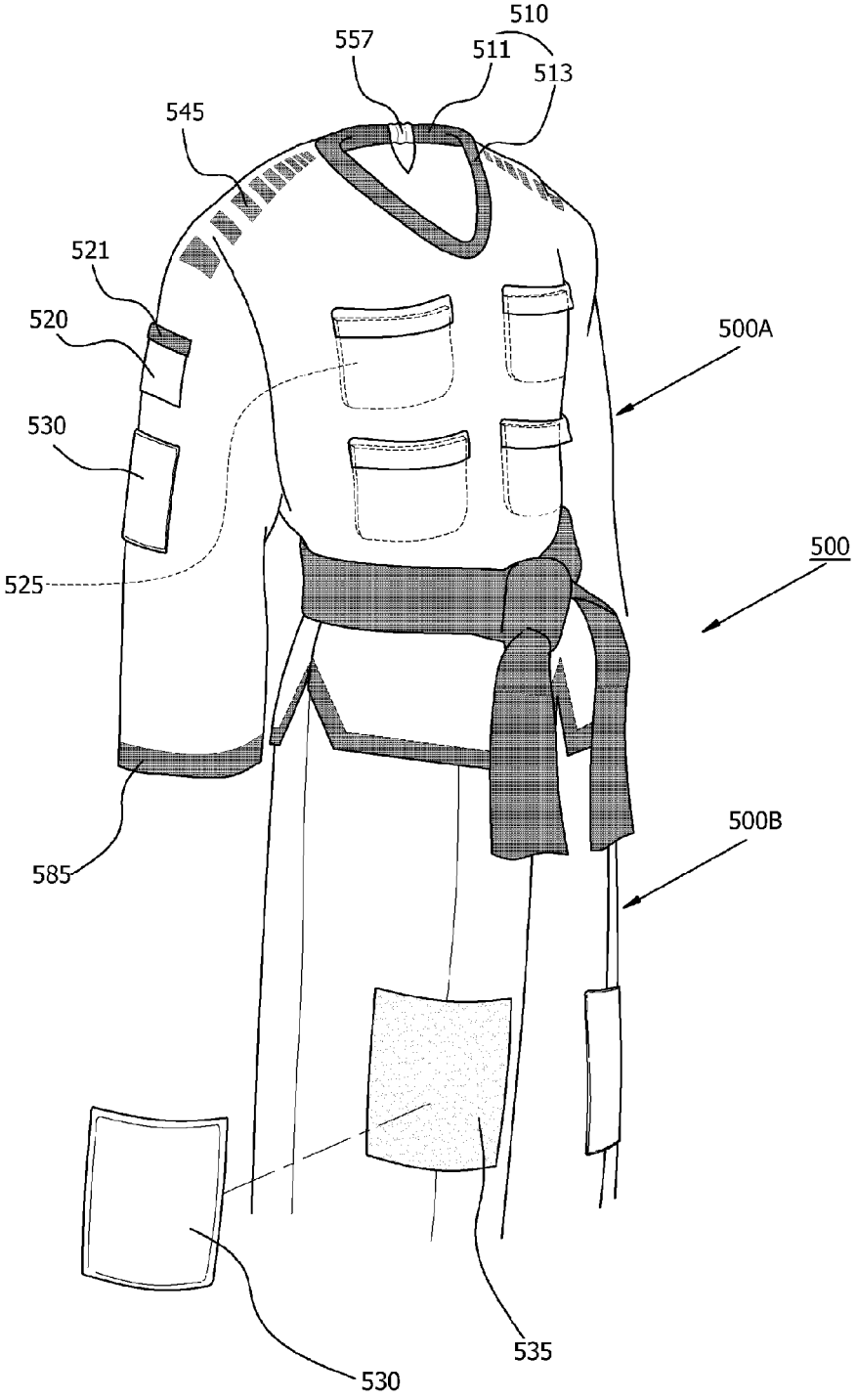
Figure 6:
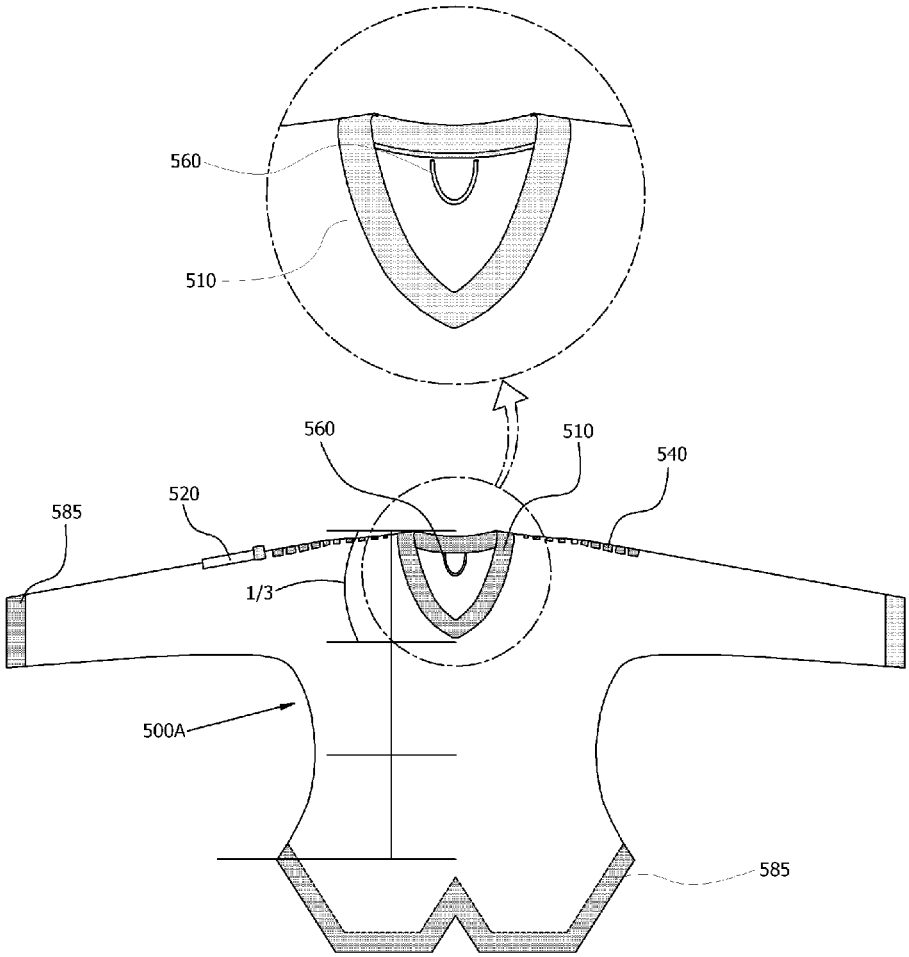
FIGS. 6 and 7 are perspective views showing the top and the bottoms of the taekwondo uniform according to the first embodiment of the present invention.
Figure 7:
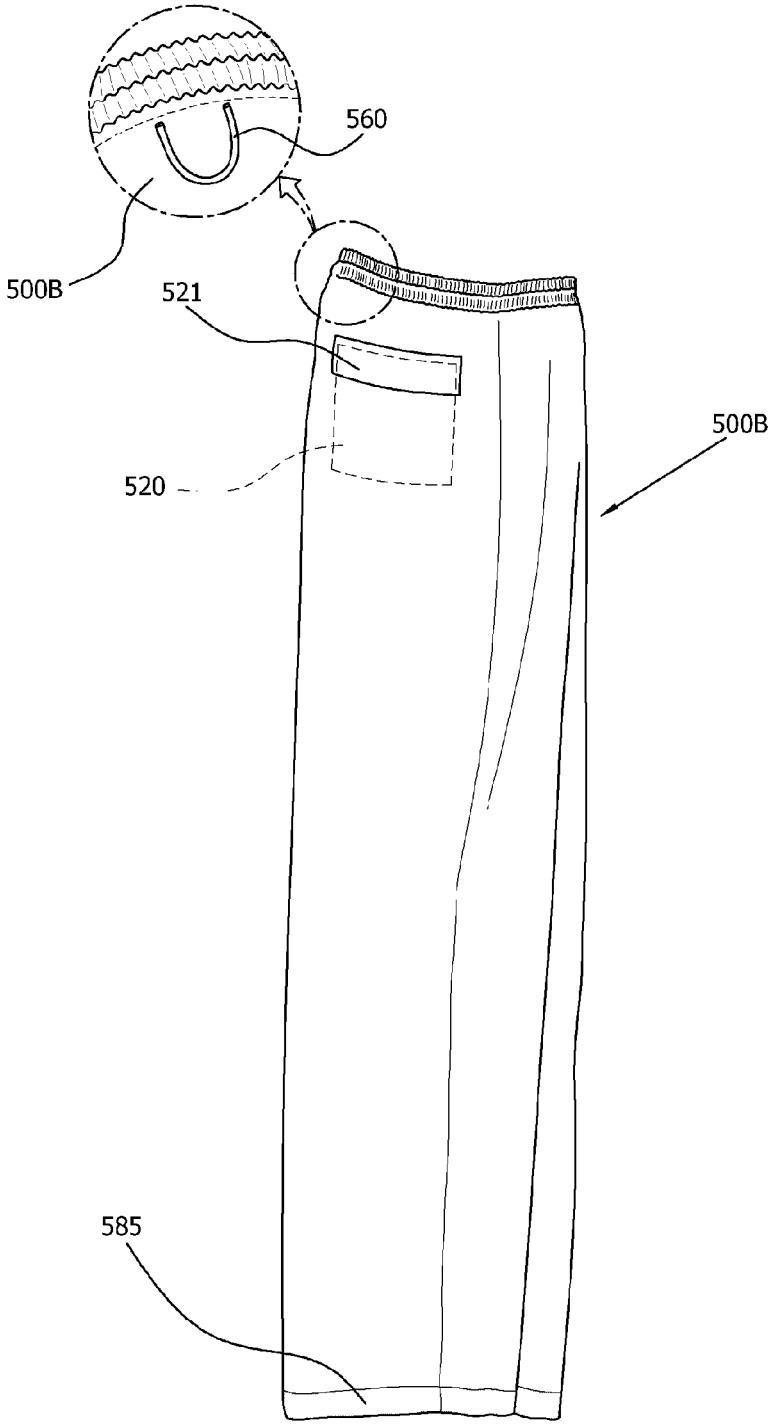

FIG. 2 is a perspective view showing a taekwondo uniform according to the present invention, FIGS. 3 and 4 are perspective views showing the top and the bottoms of the taekwondo uniform according to the present invention, and FIG. 5 is a perspective view showing the taekwondo uniform according to the present invention when the taekwondo uniform is put on. FIGS. 6 and 7 are perspective views showing the top and the bottoms of the taekwondo uniform according to the first embodiment of the present invention.

A uniform 500 according to the present invention includes a uniform top 500A and uniform bottoms 500B.

The uniform top 500A has a shape corresponding to a human body in at least a portion thereof, and includes a neck insertion part 510 provided around the neck of a person and having a vertical length between the upper and lower end portions which is ⅓ of the total vertical length of the uniform top 500A.

In this case, the neck insertion part 510 has the structure in which an upper line 511 having the shape of a curved line or a straight line and a lower line 513, which has the shape of the curved line or the straight line and both end portions mutually coupled with each other at one point, are continuously formed.

As shown in FIG. 6, preferably, in the neck insertion part 510 according to the present invention, the upper line 511 has the shape of a curved line, and the lower line 513 linked with the upper line 511 at both sides of the lower line 513 has the shape of a curved line. In addition, a collar, which may have various shapes, may be additionally attached to the neck insertion part 510.

The neck insertion part 510 further includes a size adjusting part 557 formed by cutting at least a portion of the neck insertion part 510 and linking the cutting ends with each other through a rubber band, a button, and a ring suspended by the button, or including an elastic band to prevent clothes from slipping down, so that the size of the neck insertion part 510 can be adjusted.

In addition, the uniform top 500A or the uniform bottoms 500B are additionally provided at one side thereof with a pocket 520 having a cover 521 at the upper portion thereof.

In this case, when the pocket 520 is provided at the front surface or the rear surface of the uniform top 500A, a shock absorbing plate 525 or a sensor (not shown) to detect a blow may be provided inside the pocket 520.

In addition, the uniform top 500A has fitting lines 550 extending from both sides of a bottom surface of a shoulder part 540 (that is, armpits) to a waist part of the uniform top 500A.

In this case, the fitting lines 550 are portions of the uniform top 500A to minimize the width of the uniform top 500A so that the fitting lines 550 are close to the waist of a user to prevent the uniform top 500A from being loosed. The fitting lines 550 are formed as continuous straight lines or curved lines. If the fitting lines 550 are the continuous curved lines, the curved lines have arcs protruding outward toward the lower portion of the uniform top 500A.

In addition, the fitting line 550 is provided at the lower portion thereof with an opening 570.

In this case, the opening 570 includes an opening adjusting part 575, such as a zipper, a hook and loop tape, or an elastic band, so that the opening degree can be adjusted.

Further, the shoulder part 540 has a shoulder pattern 545 so that the user is strongly shown.

In addition, a reinforcement-material plate 530 is additionally provided at the shoulder part 540 or an elbow part of the uniform top 500A, or a hip part or a knee part of the uniform bottoms 500B.

In this case, the reinforcement-material plate 530 is detachably provided through the hook and loop tape 535.

In addition, patch parts 585 are additionally provided at end portions of the uniform top 500A or the uniform bottoms 500B.

Meanwhile, the uniform bottoms 500B are provided at one side thereof with a shape maintaining part 597.

In addition, the taekwondo uniform 500 further includes ring parts 560 provided at the inner portion or the outer portion of the uniform top 500A or the uniform bottoms 500B.

Figure 8:
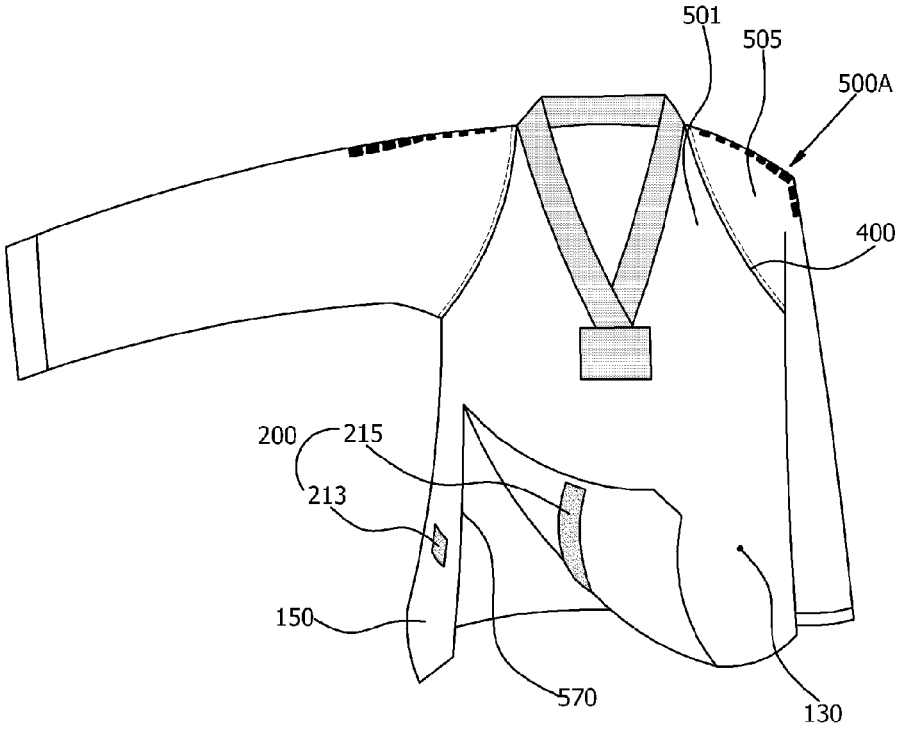
FIG. 8 is a perspective view showing the taekwondo uniform according to the second embodiment of the present invention.
Figure 9:
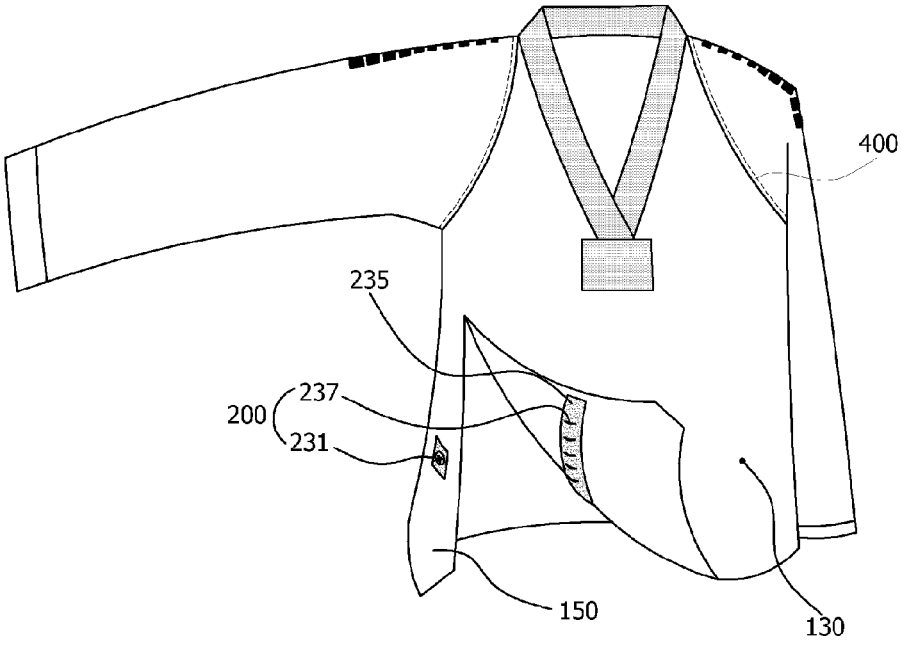
FIG. 9 is a perspective view showing the taekwondo uniform according to the third embodiment of the present invention.
Figure 10:
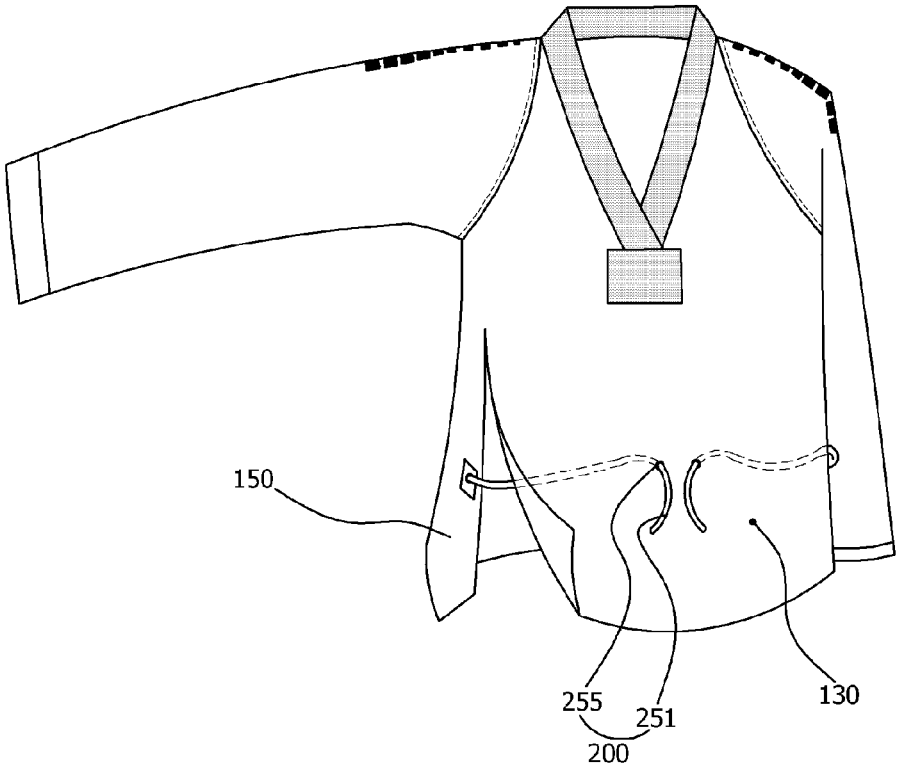
FIGS. 10 and 11 are views showing band connection states of the taekwondo uniform according to the fourth embodiment of the present invention.
Figure 11:
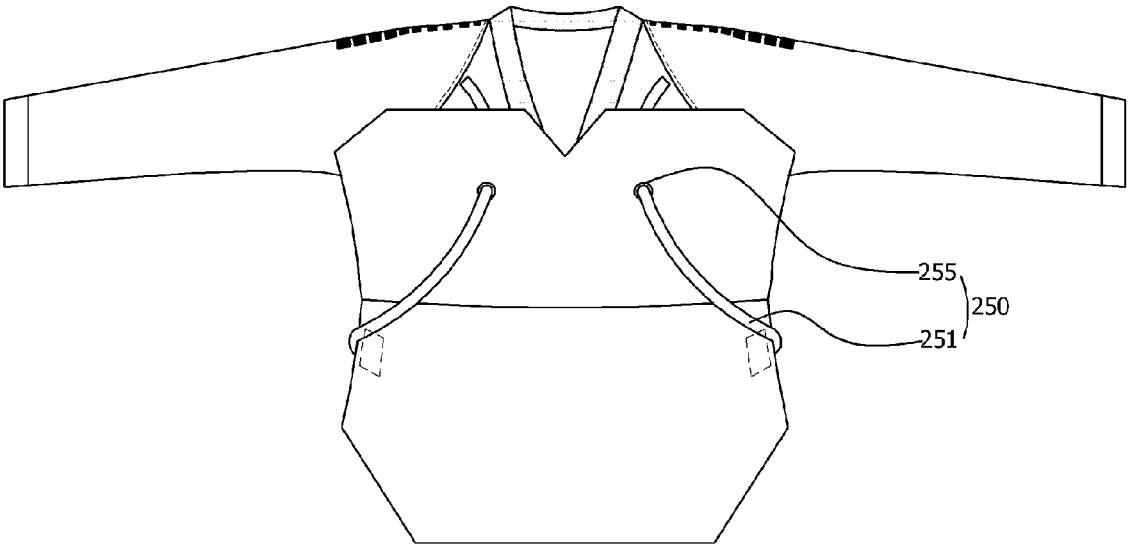
Figure 12:
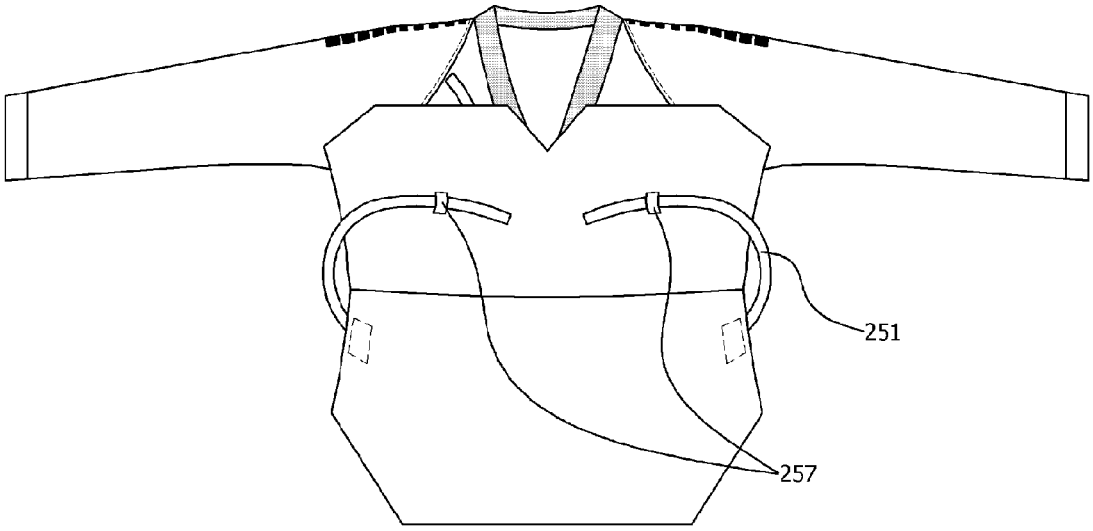
FIG. 12 is a view showing a band connection state of the taekwondo uniform according to the fifth embodiment of the present invention.
Figure 13:
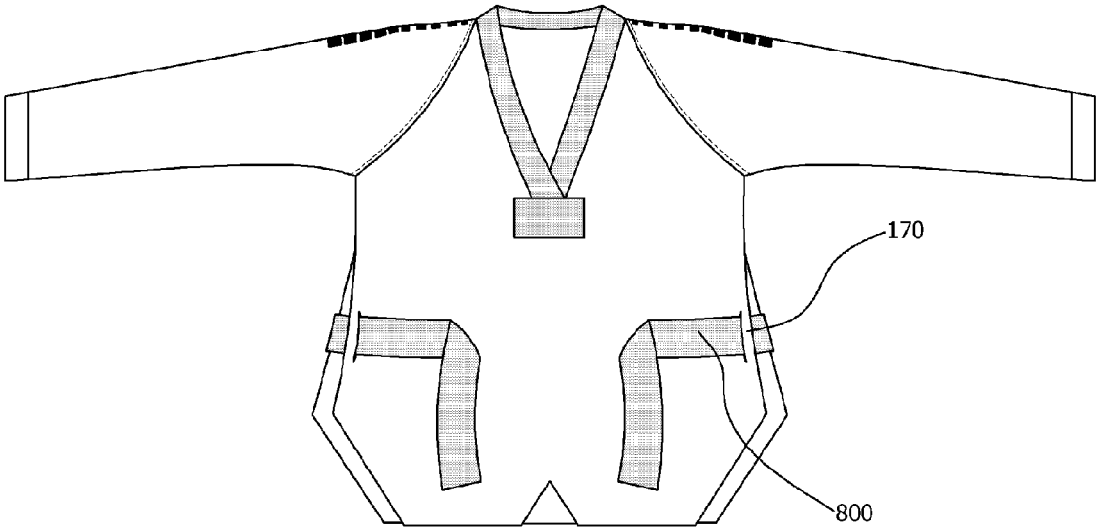
FIGS. 13 and 14 are views showing the wearing state of a uniform band according to the sixth embodiment of the present invention.
Figure 14:
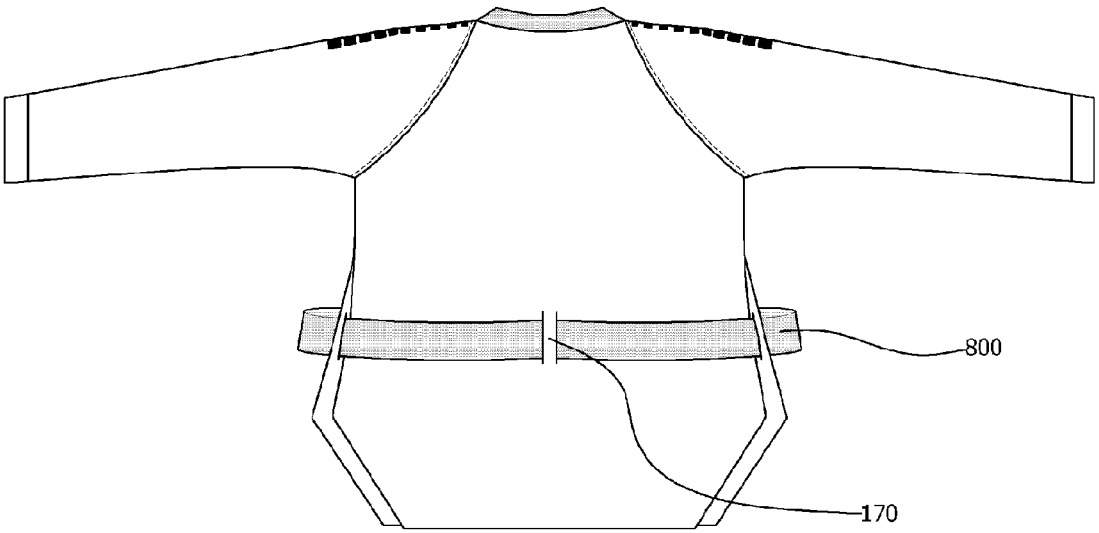
Figure 15:
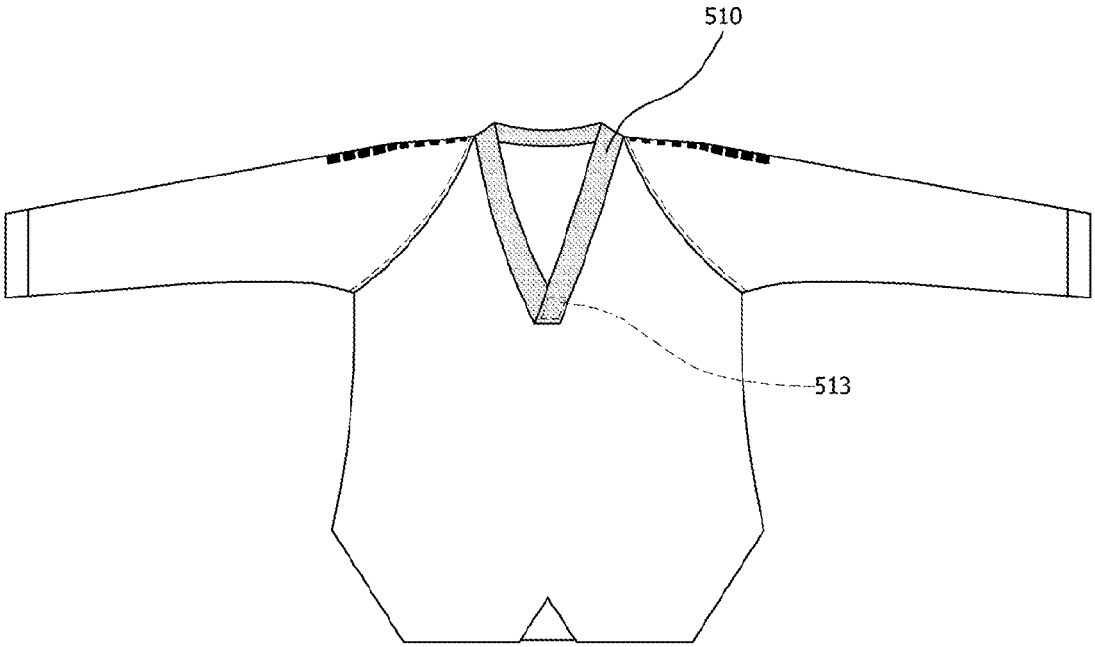
FIG. 15 is a perspective view showing a taekwondo uniform according to the seventh embodiment of the present invention.

FIG. 8 is a perspective view showing the taekwondo uniform according to the second embodiment of the present invention, FIG. 9 is a perspective view showing the taekwondo uniform according to the third embodiment of the present invention, and FIGS. 10 and 11 are views showing band connection states of the taekwondo uniform according to the fourth embodiment of the present invention. FIG. 12 is a view showing a band connection state of the taekwondo uniform according to the fifth embodiment of the present invention, FIGS. 13 and 14 are views showing the wearing state of a uniform band according to the sixth embodiment of the present invention, and FIG. 15 is a perspective view showing a taekwondo uniform according to the seventh embodiment of the present invention.

In the uniform top 500A according to the present invention, front and back parts 130 and 150, which are formed about the opening 570, are mutually linked with each other through a gap adjusting unit 200, so that the front part 130 is fitted to the body of the user while covering the back part 150.

A plurality of ring parts 170 are provided around the front and back parts 130 and 150 to support the uniform band 800, and provided at the edge of the front and back parts 130 and 150.

The gap adjusting unit 200 may include a first hook and loop tape 213 provided at the edge of the back part and a second hook and loop tape 215 provided inside the front part so that the first hook and loop tape is attached to the second hook and loop tape while moving.

Further, the gap adjusting unit 200 includes a button 231 provided at the edge of the back part and a fixing band 237 having a plurality of locking holes 235 so that the button is locked with the holes while moving.

In addition, the gap adjusting unit 200 may include bands 251 connected to edges of the back part and support holes 225 provided at the central portion of the front part, so that the band passes through the front part and be thus exposed.

In this case, the band 251 is suspended by a suspension ring 257 additionally provided inside the front part 130.

In addition, the uniform top 500A includes fastening units 300 made of mutually-opposite hook and loop tapes are provided at the overlapped portions of the lower end of the neck insertion part 510.

Subsequently, the uniform 500A has a structure in which a body part 501 is linked with a sleeve part 501 by a raglan line 400.

MODE FOR INVENTION

Hereinafter, the operation of the present invention having the above structure will be described.

As shown in FIGS. 2 to 7, the uniform 500 according to the present invention includes the fitting line 550 and the patch part 585 so that the uniform 500 is matched with the body type of a user while the uniform 500 is prevented from being loosing, thereby increasing the wearability of the uniform 500 regardless of the gender and preventing the uniform 500 from being loosed to improve the performance of taekwondo players.

In this case, the neck insertion part 510 of the uniform top 500A provided around the neck of the player has a vertical length between the upper and lower end portions which is ⅓ or less of the total vertical length of the uniform top 500A, so that the uniform 500 can be prevented from being loosed even if women wear the uniform 500.

In other words, if the vertical length from the upper end of the upper line 511 of the neck insertion part 510 and the horizontal line passing through the end portion of the lower line 513 exceeds ⅓ of the vertical line between the upper end of the uniform top 500A and the horizontal line passing through the lower end of the uniform top 500A, the end portion of the neck insertion part is provided at a position to reveal the breasts of the woman, so that the breasts of the woman may be revealed even if the loosing degree of the uniform is minimized.

In addition, the neck insertion part 510 has the structure in which the upper line 511 having the shape of a curved line or a straight line and the lower line 513, which has the shape of the curved line or the straight line and both end portions mutually coupled with each other at one point, are continuously formed. When a user puts on the uniform, the neck insertion part is fitted to the neck of the user and liked at one point in a non-overlap state, thereby preventing the toes of the opponent from being seized by the neck insertion part.

In this case, as shown in FIG. 5, if the upper line 511 of the neck insertion part 510 is curved, the upper line 511 of the neck insertion part 510 is fitted to the neck of the user, thereby solving the problem in which the neck part of the uniform is tilted back. In addition, the lower line 513 coupled with both sides of the upper line 511 is substantially curved, so that the uniform is fitted to the human body, thereby reducing the loosing degree of the uniform.

In addition, the collar that may have various shapes is additionally attached to the neck insertion part 510, so that the taekwondo uniform can be variously presented.

Further, the neck insertion part 510 further includes the size adjusting part 557, which is elastically formed by using a rubber band, in at least a portion of the neck insertion part 510. Accordingly, the user can easily put on the uniform regardless of the size of the user head.

In addition, since the uniform top 500A or the uniform bottoms 500B are additionally provided at one side thereof with the pocket 520 having the cover 521 at the upper portion thereof, the user can store a cellular phone or a ballpoint pen in the pocket even if the user puts on the uniform. In addition, the cover 521 prevents the toes of an opponent from being seized by the pocket.

In this case, when the pocket 520 is provided at the front surface or the rear surface of the uniform top 500A, and the shock absorbing plate 525 is provided inside the pocket 520, the shock caused by the blow is prevented from being transferred to the user.

In addition, the uniform top 500A has the fitting lines 550 extending to both sides of the lower portion of the uniform top 500A along the bottom surface of the shoulder part 540 (that is, armpit) such that the uniform is fitted to the body of the user. Accordingly, the unnecessary space is minimized, so that the uniform can be prevented from loosed.

In this case, the fitting lines 550 are portions of the uniform top to minimize the width of the uniform top 500A so that the fitting lines 550 are close to the waist of a user to prevent the uniform top from being loosed. The fitting lines are formed as continuous straight lines or curved lines. If the fitting lines 550 are the continuous curved lines, the curved lines have arcs protruding outward toward the lower portion of the uniform top 500A. Accordingly, the fine outer portion of the uniform is provided and the uniform is prevented from being loosed.

The opening 570 formed at the lower portion of the fitting line 550 includes the opening adjusting part 575, such as a zipper, so that the opening degree of the opening 570 can be adjusted. Accordingly, as the opening degree is adjusted, the fitting degree of the uniform can be adjusted.

Further, the shoulder part 540 has the shoulder pattern 545 so that the shoulder part 540 becomes conspicuous. Accordingly, the user is strongly shown.

In addition, the reinforcement-material plate 530 is additionally provided at the shoulder part 540 or the elbow part of the uniform top 500A, or the hip part or the knee part of the uniform bottoms 500B, thereby minimizing the shock caused by the ground surface or the blow.

In this case, the reinforcement-material plate 530 is detachably provided through the hook and loop 535. Accordingly, the user can use the reinforcement-material plate 530 by attaching or detaching the reinforcement-material plate 530 if necessary.

In addition, the patch parts 585 are additionally provided at end portions of the uniform top 500A or the uniform bottoms 500B. Accordingly, the center of the gravity of the uniform is down, so that the uniform can be prevented from being loosed and prevented from being worn due to the friction.

The patch parts 585 may be formed by sewing the end portion of the taekwondo uniform 500 folded several times. In addition, the patch parts 585 may be formed by attaching another cloth to the uniform and sewing the result.

Meanwhile, the uniform bottoms 500B are integrally formed at one side thereof with the shape maintaining part 597 formed through the sewing process to maintain the shape of the uniform bottoms 500B. Accordingly, the bending of the uniform bottoms 500B may be minimized, and the uniform bottoms 500B may be maintained in the predetermined shape.

In addition, the taekwondo uniform 500 further includes the ring parts 560 provided at the inner portion or the outer portion of the uniform top 500A or the uniform bottoms 500B. Accordingly, the taekwondo uniform 500 may be easily hung on the wall or the hanger so that the taekwondo uniform 500 can be supported.

As described above, the uniform 500 according to the present invention is matched with the body type of a user regardless of the gender, so that the dressing style of the user can stand out, and the performance of the user can be prevented from being degraded due to the loosing of the uniform 500.

As shown in FIGS. 8 to 15, the uniform top 500A according to the present invention has a structure in which the sleeve part 501 is linked to the body part 505 by the raglan line 400 serving as a sewing line coupling the sleeve part having a cutting line (stitch) extending the collar to the armpit.

In the uniform top 500A according to the present invention, the front and back parts 130 and 150, which are formed about the opening 570, are mutually linked with each other through the gap adjusting unit 200, so that a portion of the edge of the front part 130 constituting the opening is fitted to the body of the user while covering the back part 150. Accordingly, the uniform can be prevented from being loosed, and the wearability of the uniform can be increased.

A plurality of the ring parts 170 to support the uniform band 800 are provided around the front and back parts 130 and 150 such that the uniform band 800 is inserted into the ring parts 170. Accordingly, the uniform band supports the uniform to prevent the uniform from being moved. Accordingly, the uniform top 500A is prevented from being loosed.

In this case, the ring parts 170 are provided at the central portion of the back part 150 and the edges of the front part 130, so that the edge of the front part is fitted in the state that the edge of the front part is overlapped with the back part.

The gap adjusting unit 200 includes the first hook and loop tape 213 provided at the edge of the back part and the second hook and loop tape 215 provided inside the front part so that the first hook and loop tape is attached to the second hook and loop tape while moving. Accordingly, the first hook and loop tape 213 is moved along the second hook and loop tape 215 and then bonded to the second hook and loop tape 215, so that the fitting degree between the uniform and the body can be adjusted.

Further, the gap adjusting unit 200 includes the button 231 provided at the edge of the back part and the fixing band 237 having a plurality of the locking holes 235 so that the button is inserted into the locking holes while moving. Accordingly, the button is inserted into the locking holes, so that the front part is fitted in the state that the front part is overlapped with the outer portion of the back part.

In addition, the gap adjusting unit 200 may include the bands 251 connected to edges of the back part and the support holes 225 provided at the central portion of the front part, so that the band passes through the front part and be thus exposed. Accordingly, after the band 251 has been exposed at the front of the front part 130 through the support holes 225, the band 251 is knotted. In this case, the edge of the front part is fitted in the state that the edge of the front part is overlapped with the outer portion of the back part.

In this case, the band 251 is inserted into the suspension ring 257 additionally provided on the inner surface of the front part 130 without being exposed to the outside.

In addition, the uniform top 500A includes the fastening units 300 made of Velcro-tapes provided at the overlapped portions of the lower end of the neck insertion part 510 while corresponding to each other, thereby adjusting the width of the neck insertion part 510 into which the neck of the user is inserted, and preventing the uniform from being loosed due to the movement of the user.

INDUSTRIAL APPLICABILITY

The present invention is applicable to a taekwondo uniform. Accordingly, when the user puts on the taekwondo uniform, the taekwondo uniform is fitted to the body of the user, thereby minimizing the loosing of the uniform. Accordingly, the women and men can put on the taekwondo uniform in common.

The invention claimed is:

1. A taekwondo uniform top, comprising:

a neck insertion part having a shape of a loop corresponding to a neck line of a human body, an upper line having a shape of a curved line, and a lower line having a shape of another curved line, wherein the upper line and the lower line are mutually coupled with each other at one point, thereby forming the neck insertion part;

a fitting line disposed throughout an armpit part and a lower portion of the uniform top, wherein the fitting line is a continuous curved line with an arc protruding outward toward the lower portion of the uniform top, an opening disposed on the lower portion of the uniform top;

an opening adjusting part to adjust an opening degree of the opening disposed on the lower portion of the uniform top;

a ring part disposed at an inner portion or an outer portion of the uniform top for hanging the uniform top;

a reinforcement material plate disposed at one side thereof and detachably provided by using a fastener member;

a patch part disposed at a lower end portion thereof and configured to keep the center of gravity of the uniform top downward; and a front part and a back part, which form the opening therebetween disposed on the lower portion of the uniform top and are mutually linked with each other through a gap adjusting unit, so that the front part and the back part are fitted to a body of a user in a state that an edge of the front part covers an edge of the back part, wherein the gap adjusting unit includes a first hook and loop tape disposed at an outside edge of the back part and a second hook and loop tape disposed inside the front part and parallel to the first hook and loop tape, wherein the first hook and loop tape is configured to be moved along the second hook and loop tape and be attached to the second hook and loop tape, and wherein the first hook and loop tape is shorter than the second hook and loop tape in length.

2. The taekwondo uniform top of claim 1, wherein the fitting line is configured to maximize a width of the uniform top so that the fitting line is close to a waist of a user to prevent the uniform top from being too loose.

3. The taekwondo uniform top of claim 1, wherein the neck insertion part is formed such that a vertical length between upper and lower end portions thereof corresponds to ⅓ based on a total vertical length of the uniform top, and the neck insertion part is provided at one side thereof with a size adjusting part.

4. The taekwondo uniform top of claim 1, wherein the uniform top is additionally provided at one side thereof with a pocket.

5. The taekwondo uniform top of claim 1, wherein the uniform top further includes a shoulder part having a shoulder pattern.

6. The taekwondo uniform top of claim 1, wherein the uniform top further includes a plurality of ring parts provided around the front part and the back part to support a uniform band.

7. The taekwondo uniform top of claim 1, wherein the uniform top further includes a fastening unit including mutually-opposite hook and loop tapes provided at overlapped portions of a lower end of the neck insertion part, and a sleeve part is linked with a body part by a raglan line.

* * * * *